US009405224B2

(12) United States Patent
Furutani et al.

(10) Patent No.: US 9,405,224 B2
(45) Date of Patent: Aug. 2, 2016

(54) DEVELOPER ACCOMMODATING CONTAINER WITH FLEXIBLE MEMBERS FORMING INJECTION OPENING

(71) Applicant: CANON KABUSHIKI KAISHA, Tokyo (JP)

(72) Inventors: Masaki Furutani, Tokyo (JP); Junichi Matsumura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/019,631

(22) Filed: Sep. 6, 2013

(65) Prior Publication Data

US 2014/0072347 A1 Mar. 13, 2014

(30) Foreign Application Priority Data

Sep. 11, 2012 (JP) ..... 2012-199455

(51) Int. Cl.
*G03G 15/00* (2006.01)
*G03G 15/08* (2006.01)

(52) U.S. Cl.
CPC ..... *G03G 15/0874* (2013.01); *G03G 15/0882* (2013.01)

(58) Field of Classification Search
CPC ..... G03G 15/0874; G03G 15/0843; G03G 15/0882
USPC ..... 399/105, 119, 262; 220/9.4, 495.01, 220/495.06
See application file for complete search history.

(56) References Cited

U.S. PATENT DOCUMENTS

| | | | | | |
|---|---|---|---|---|---|
| 4,322,465 | A * | 3/1982 | Webster | 428/194 |
| 4,766,457 | A * | 8/1988 | Barker et al. | 399/106 |
| 5,075,727 | A * | 12/1991 | Nakatomi | 399/103 |
| 5,079,591 | A * | 1/1992 | Tomita et al. | 399/262 |
| 5,802,431 | A * | 9/1998 | Nagashima et al. | 399/262 |
| 5,996,845 | A * | 12/1999 | Chan | 222/107 |
| 6,298,885 | B1 * | 10/2001 | Yoshino et al. | 141/114 |
| 6,898,405 | B2 * | 5/2005 | Matsumoto et al. | 399/262 |
| 2004/0071481 | A1 * | 4/2004 | Katsuyama | 399/258 |
| 2012/0063806 | A1 * | 3/2012 | Kubota et al. | 399/103 |
| 2012/0177414 | A1 * | 7/2012 | Ikeguchi et al. | 399/262 |
| 2013/0136489 | A1 | 5/2013 | Yamaguchi et al. | |

(Continued)

FOREIGN PATENT DOCUMENTS

| | | | |
|---|---|---|---|
| JP | 4-66980 | A | 3/1993 |
| JP | 07044006 | A * | 2/1995 |

OTHER PUBLICATIONS

English Translation of Yasuda et al. Toner Cartridge. Feb. 14, 1995. Japanese Patent Office. JPH07-044006.*

(Continued)

*Primary Examiner* — Clayton E Laballe
*Assistant Examiner* — Trevor J Bervik
(74) *Attorney, Agent, or Firm* — Fitzpatrick, Cella, Harper & Scinto

(57) ABSTRACT

A developer accommodating container for accommodating developer for image formation. The developer accommodating container includes a first flexible member having a folded shape and a second flexible member for forming a space for accommodating the developer by covering a part of the first flexible member. The first flexible container and the second flexible container form an injection opening for permitting injection of developer into the space. As seen from an injection direction, the folded shape has a recess.

21 Claims, 15 Drawing Sheets

(56) References Cited

U.S. PATENT DOCUMENTS

| | | | |
|---|---|---|---|
| 2013/0164039 | A1 | 6/2013 | Matsushita et al. |
| 2013/0336679 | A1 | 12/2013 | Furutani et al. |
| 2013/0343785 | A1 | 12/2013 | Matsuzaki et al. |
| 2014/0016961 | A1 | 1/2014 | Yasui et al. |
| 2014/0029974 | A1 | 1/2014 | Uesugi et al. |

OTHER PUBLICATIONS

Nov. 4, 2015 Office Action in Chinese Patent Application No. 20130402977.1 (with English translation).

* cited by examiner

DEVELOPER ACCOMMODATING CONTAINER WITH FLEXIBLE MEMBERS FORMING INJECTION OPENING

FIELD OF THE INVENTION AND RELATED ART

The present invention relates to an image forming apparatus, and a developer accommodating container to be used in the image forming apparatus, and a process cartridge.

The image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine and the like. The cartridge is prepared by integrally constituting at least a developing means and a developing device accommodating a developer and is made detachably mountable to an image forming apparatus main assembly, or the cartridge is prepared by integrally constituting the developing device and a photosensitive member unit including at least a photosensitive member and is made detachably mountable to the image forming apparatus main assembly.

Further, a developer accommodating container and the developer accommodating unit are accommodated in the image forming apparatus or the cartridge, and include a flexible container for accommodating the developer.

In a conventional electrophotographic image forming apparatus, a process cartridge type in which an electrophotographic photosensitive member and a process means actable on the photosensitive member are integrally assembled into a cartridge and the cartridge is made detachably mountable to an electrophotographic image forming apparatus main assembly has been employed.

In such a process cartridge, as shown in FIG. 15, a developer is filled from an opening (portion) provided to a developer accommodating frame 31 for accommodating the developer and then is sealed with a toner seal 32 as a sealing member. Further, during use, a bonding portion 33 of the toner seal 32 is peeled off to unseal the opening to permit supply of the developer. Such a type has been widely employed (Japanese Laid-Open Patent Application (JP-A) Hei 4-66980).

Further, a process cartridge using a deformable inside container as a countermeasure against such a problem that the developer is scattered in the process cartridge in a filling step of the developer during manufacturing of the process cartridge has been devised (JP-A Hei 4-66980).

As in JP-A Hei 4-66980, in a constitution in which the deformable inside container and an elastic member are used, filling of the developer from the opening for permitting discharge of the developer involves many problems in manufacturing, and further it takes much cost in some cases.

SUMMARY OF THE INVENTION

A principal object of the present invention is to provide a developer accommodating container and the like capable of easily filling a developer from an opening and having a high reliability of a filling step during filling of the developer.

According to an aspect of the present invention, there is provided a developer accommodating container for accommodating a developer for image formation, comprising: a first flexible member having a three-dimensional shape; a second flexible member for forming a space for accommodating the developer by covering a part of the first flexible member;

wherein the developer accommodating container is constituted by bonding the first flexible container and the second flexible container to each other, and an injection opening, provided between the first flexible container and the second flexible container, for permitting injection of the developer into the developer accommodating container, wherein an adjacent portion adjacent to the injection opening in the three-dimensional shape has a folded shape, and wherein when the injection opening is opened, the adjacent portion expands in a direction including a directional component perpendicular to an injection direction of the developer at the injection opening.

These and other objects, features and advantages of the present invention will become more apparent upon a consideration of the following description of the preferred embodiments of the present invention taken in conjunction with the accompanying drawings.

Figure 5:
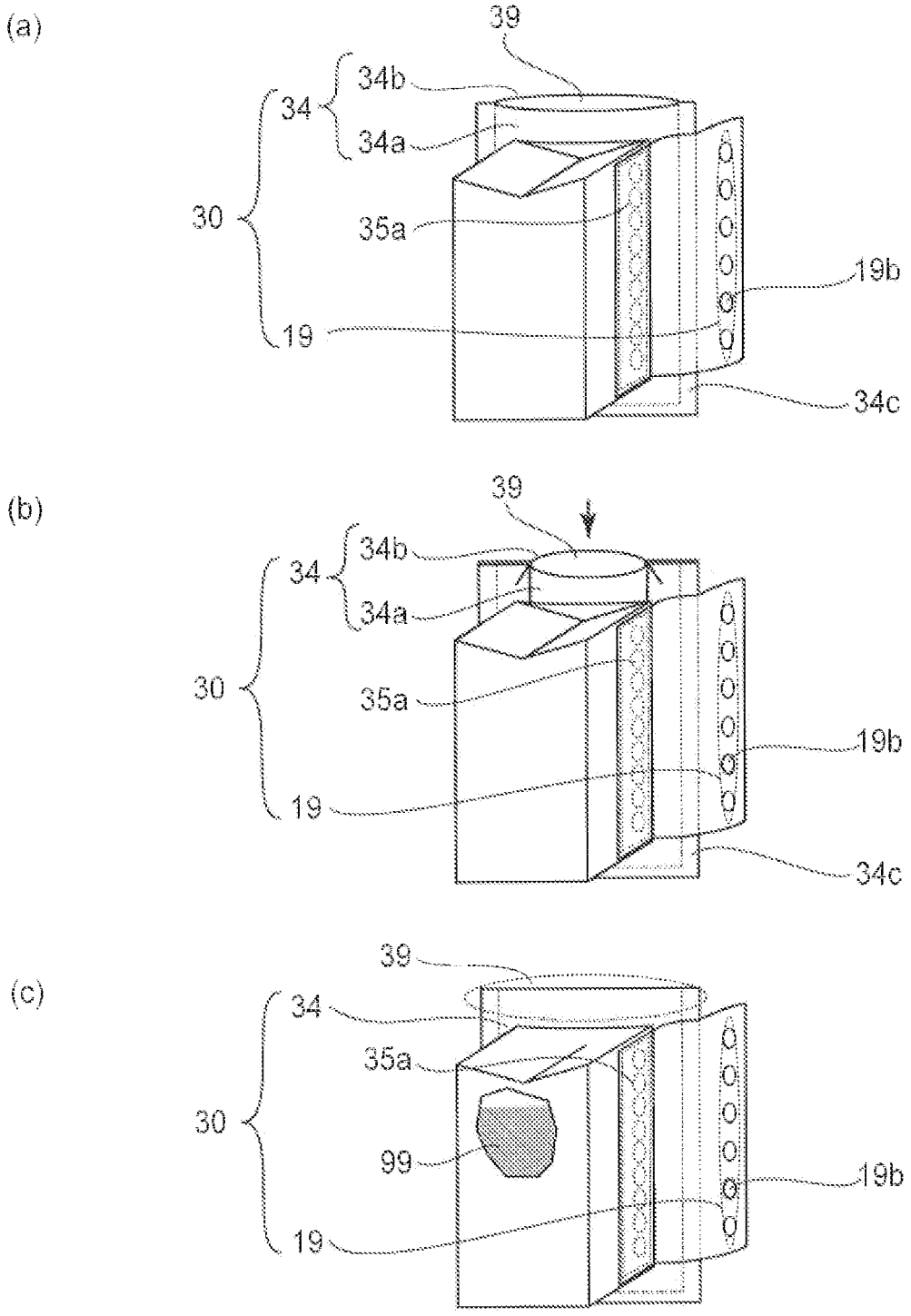

Parts (a), (b) and (c) of FIG. 5 are perspective views for illustrating states of the developer accommodating container before and after injection (filling) of a developer into the developer accommodating container, wherein (a) shows a state before an injection opening is opened, (b) shows a state in which the injection opening is opened, and (c) shows a state after the developer is injected (filled).

Figure 6:
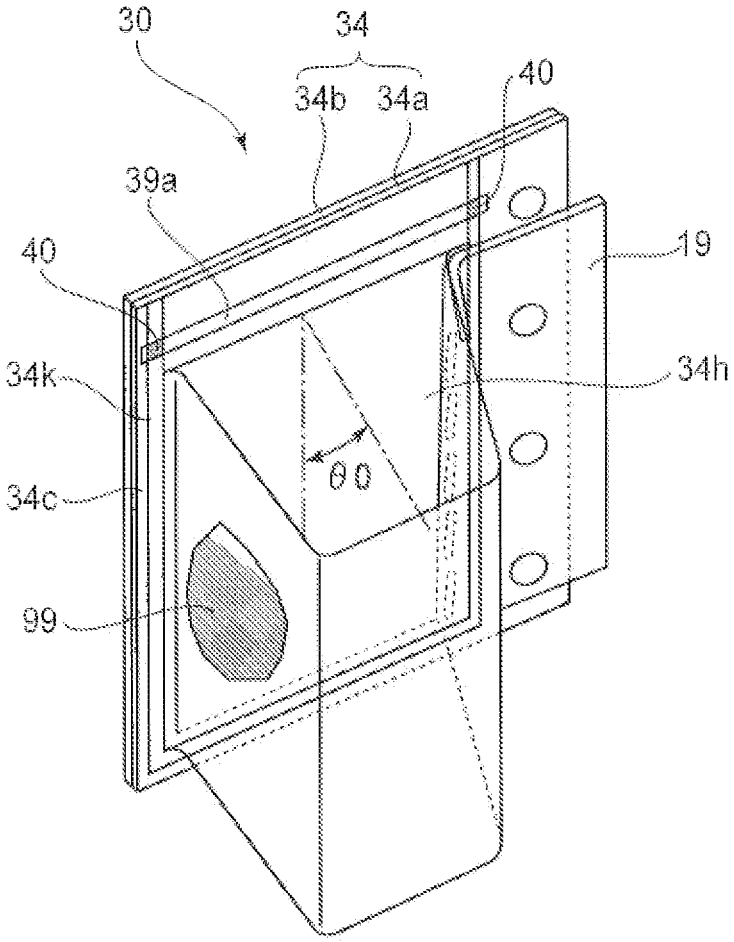

FIG. 6 is a perspective view of a developer accommodating member for illustrating unsealing of the injection opening.

Figure 7:
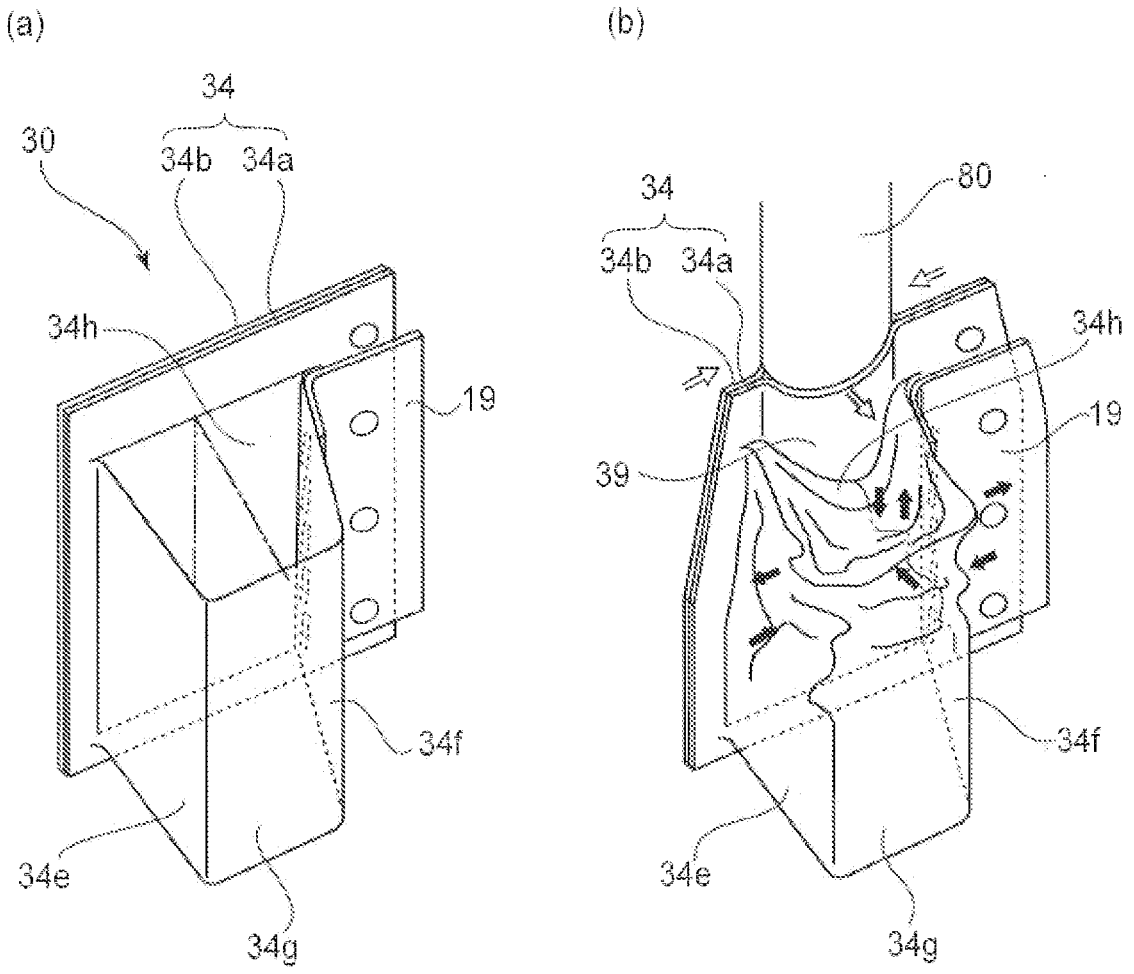

Parts (a) and (b) of FIG. 7 are perspective views showing the developer accommodating member in the case where an adjacent portion does not have a folded shape, wherein (a) shows the developer accommodating member before the unsealing, and (b) shows the developer accommodating member in a state in which a filling nozzle is inserted into the injection opening during the filling.

Figure 8:
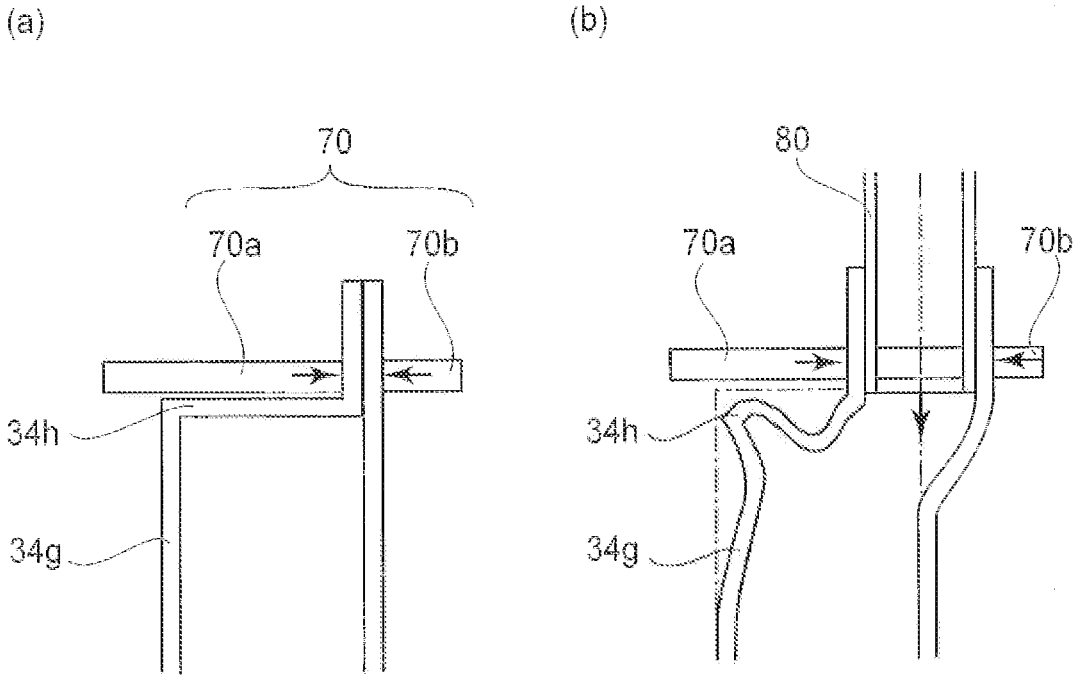

Parts (a) and (b) of FIG. 8 are sectional views each showing a cross section of the developer accommodating member shown in FIG. 7, wherein (a) and (b) are the sectional slews of the developer accommodating member 34 along a line passing through the center of the developer accommodating member 34 shown in (a) and (b) of FIG. 7, respectively.

Figure 9:
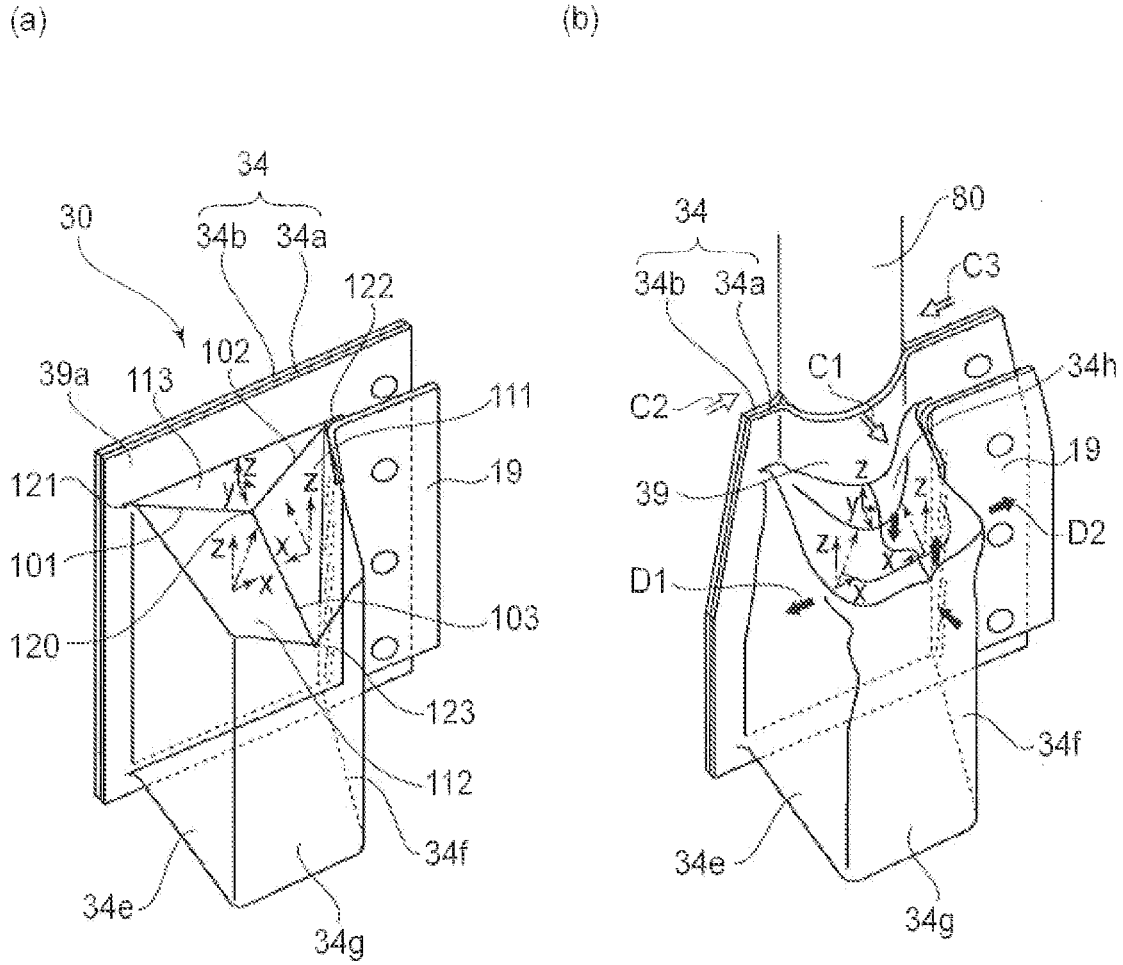

Parts (a) and (b) of FIG. 9 are perspective views showing the developer accommodating member in the case where an adjacent portion has a folded shape in Embodiment 1, wherein (a) shows the developer accommodating member before the unsealing, and (b) shows the developer accommodating member in a state in which a filling nozzle is inserted into the injection opening during the filling.

Figure 10:
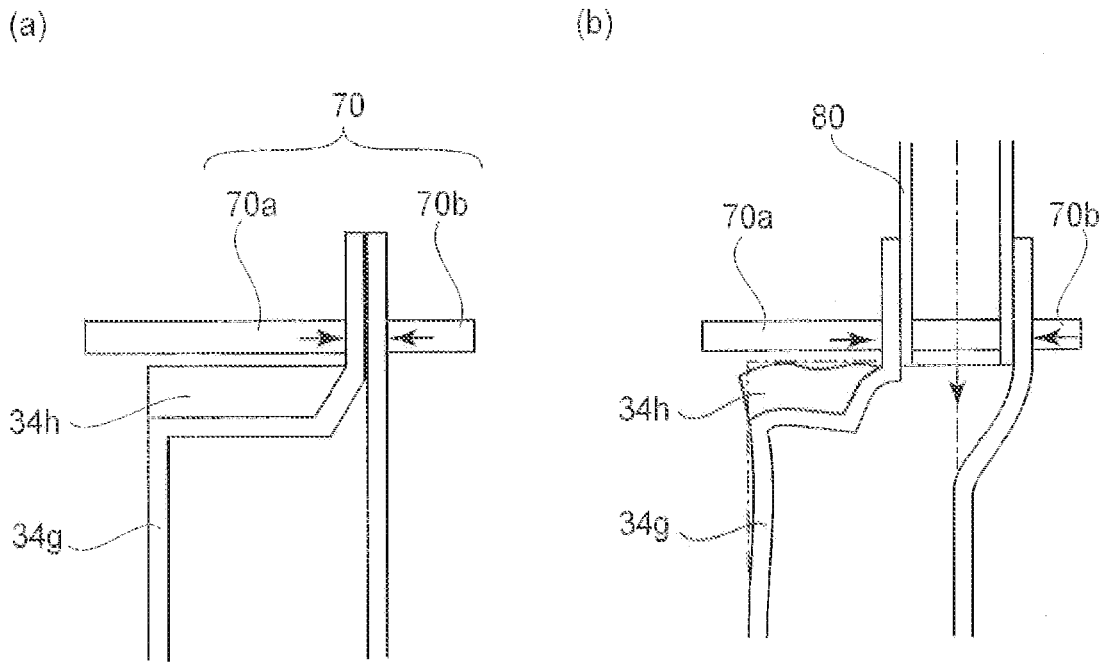

Parts (a) and (b) of FIG. 10 are sectional views each showing a cross section of the developer accommodating member shown in FIG. 7, wherein (a) and (b) are the sectional views of the developer accommodating member 34 along a line passing through the center of the developer accommodating member 34 shown in (a) and (b) of FIG. 9, respectively.

Figure 11:
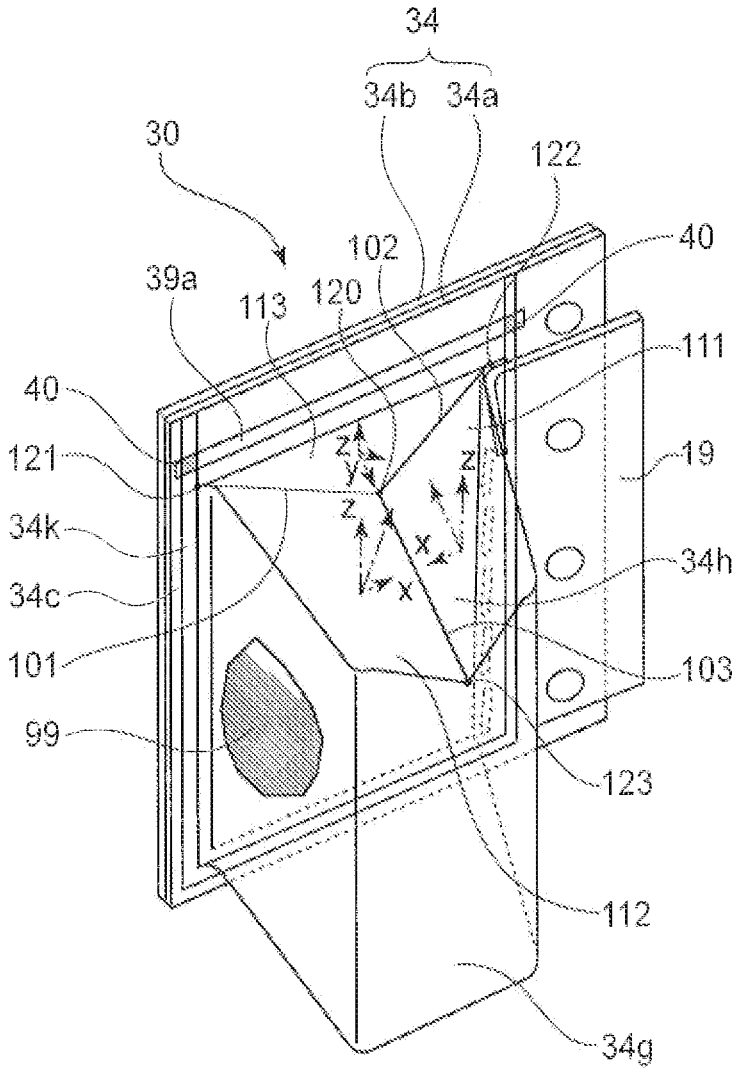

FIG. 11 is a perspective view showing the developer accommodating member after the developer is filled in the case where the adjacent portion has the folded shape.

Figure 12:
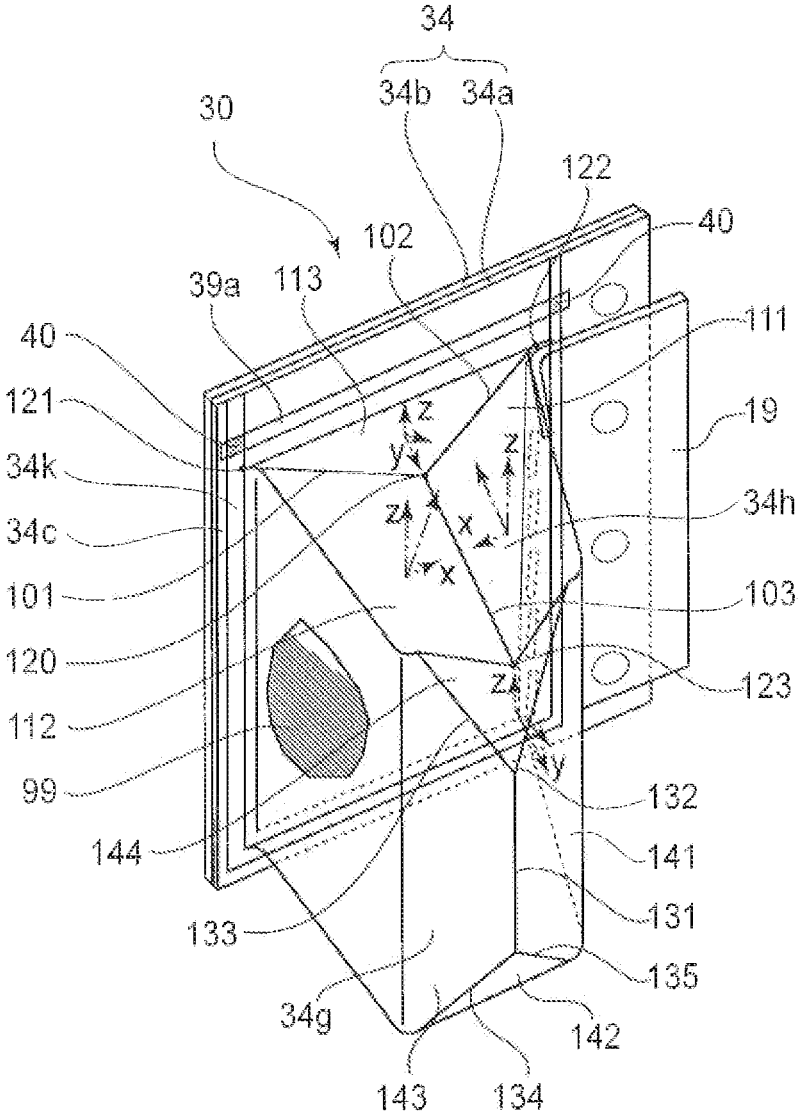

FIG. 12 is a perspective view of the developer accommodating member showing the case where the folded shape is provided also on a side adjacent to the adjacent portion adjacent to the injection opening.

Figure 13:
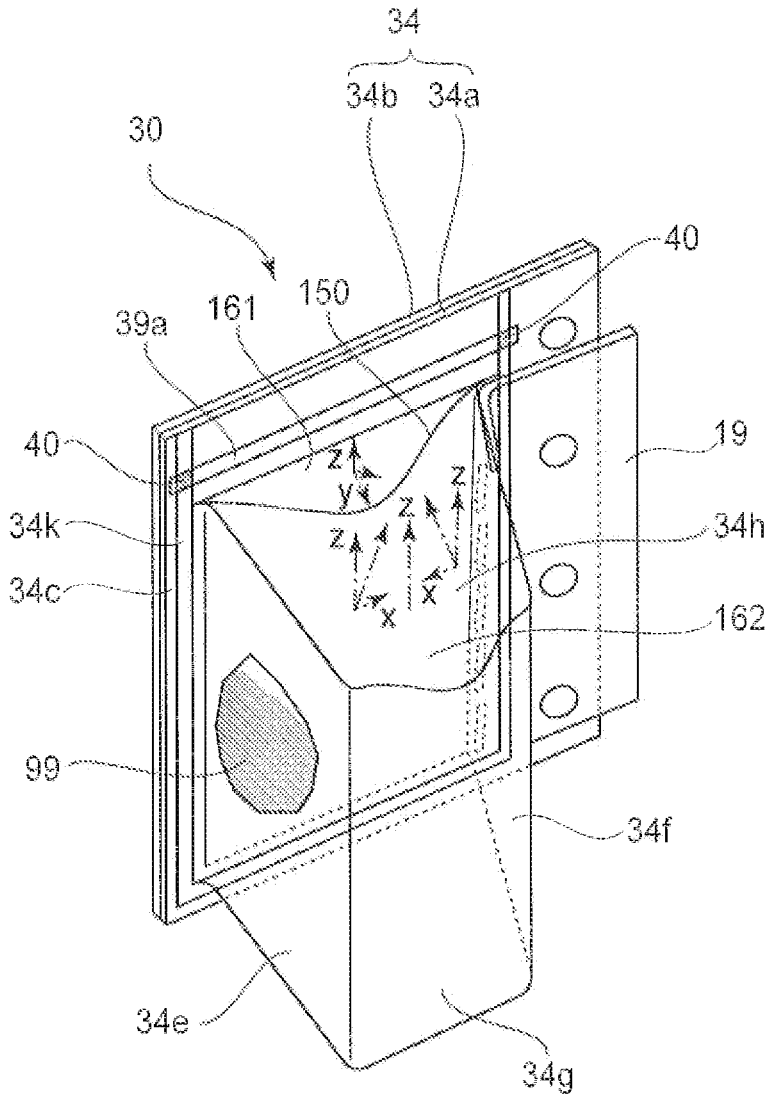

FIG. 13 is a perspective view of a developer accommodating container in the case where a folded shape of an adjacent portion adjacent to the injection opening includes a curved side.

Figure 14:
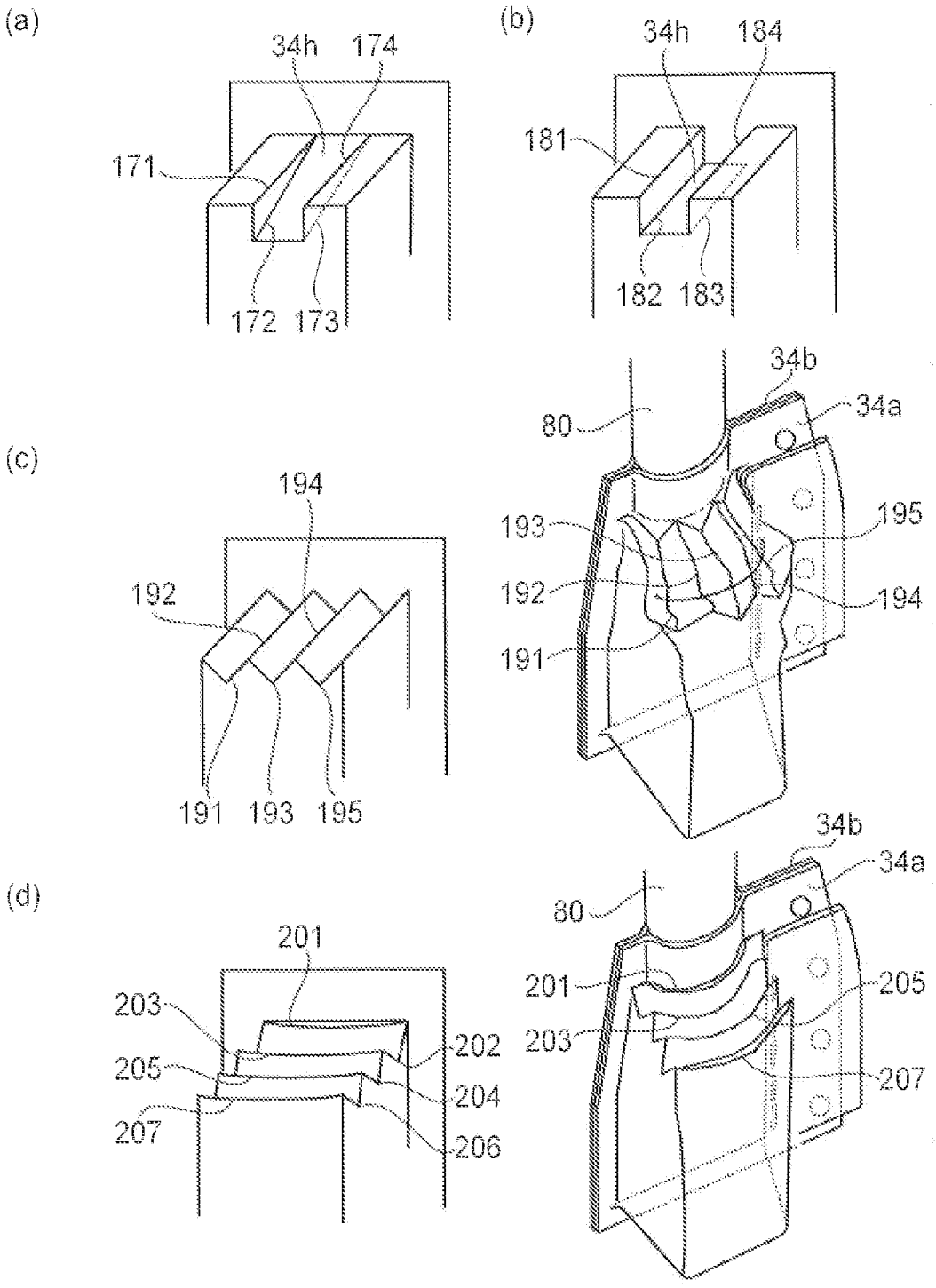

Parts (a) to (d) of FIG. 14 are perspective views showing variations of other folded shapes in other embodiments of the present invention.

Figure 15:
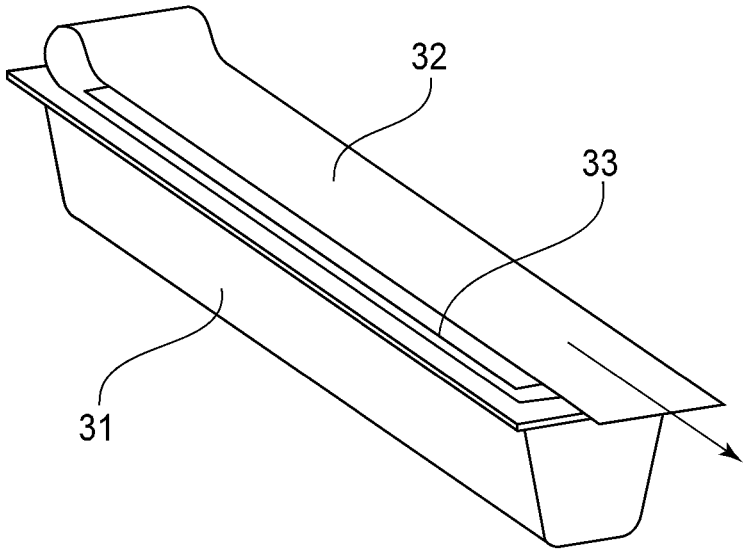
FIG.15 PRIOR ART

FIG. 15 is a perspective view showing a state of a developer accommodating portion of a process cartridge for use with a conventional image forming apparatus.

DESCRIPTION OF THE PREFERRED EMBODIMENTS

With reference to the drawings, embodiments of the present invention will be described specifically below.

In the following description, a developer accommodating container at least includes a flexible container and a sealing member, provided to the flexible container, for sealing an opening for permitting discharge of a developer.

<Embodiment 1>

(Structure of Image Forming Apparatus)

Figure 1:
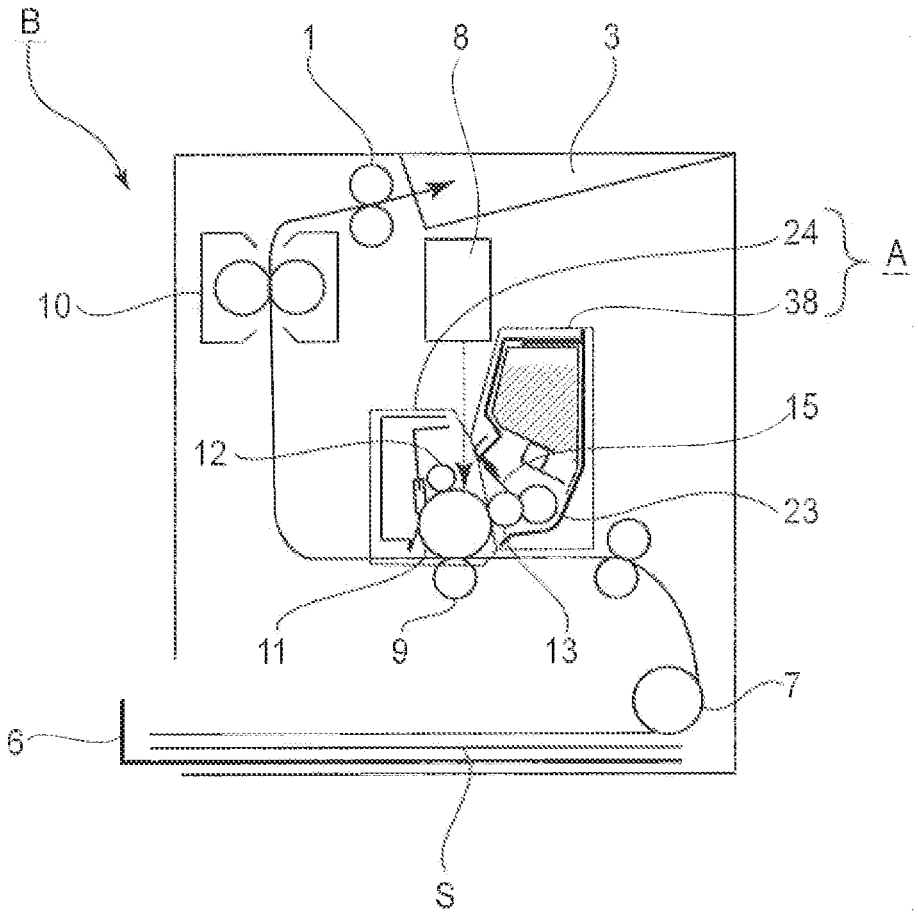
FIG. 1 is a sectional view showing a structure of an image forming apparatus in Embodiment 1 of the present invention.

FIG. 1 is a principal sectional view showing a structure of an image forming apparatus main assembly B in this embodiment.

In image formation, a sheet S (image forming material or medium) is fed by a feeding roller 7 from a sheet cassette 6 mounted at a lower portion of the image forming apparatus main assembly B, and in synchronism with the sheet feeding, a latent image is formed on a photosensitive drum 11 by effecting selective light exposure from an exposure device 8. A developer is supplied to a developing roller 13 (developer carrying member) by a sponge-like developer supplying roller 23, and is carried in a thin layer at a surface of the developing roller 13 by a developing blade 15.

By applying a developing bias to the developing roller 13, the developer is supplied depending on the latent image to develop the latent image into a desired developer image. This developer image is transferred onto the sheet S by bias voltage application to a transfer roller 9 (image transfer means). The sheet S is conveyed to a fixing device 10 and is then subjected to image fixing, and thereafter is discharged onto a discharge portion 3 at an upper portion of the image forming apparatus main assembly by a discharging roller 1.

Incidentally, a photosensitive drum 11 is provided in a cleaning unit 24, and a developing roller 13, a developer supplying roller 23 and a developing blade 15 are provided in a developing (device) unit 38. Further, the cleaning unit 24 and the developing unit 38 constitute a process cartridge A.

(Structure of Process Cartridge)

The process cartridge includes an image bearing member and process means actable on the image bearing member. Here, as the process means, there are, e.g., a charging means for electrically charging a surface of the image bearing member, a developing device for forming an image on the image bearing member, and a cleaning means for removing a developer (containing a toner, a carrier and the like) remaining on a surface of the image bearing member.

Figure 2:
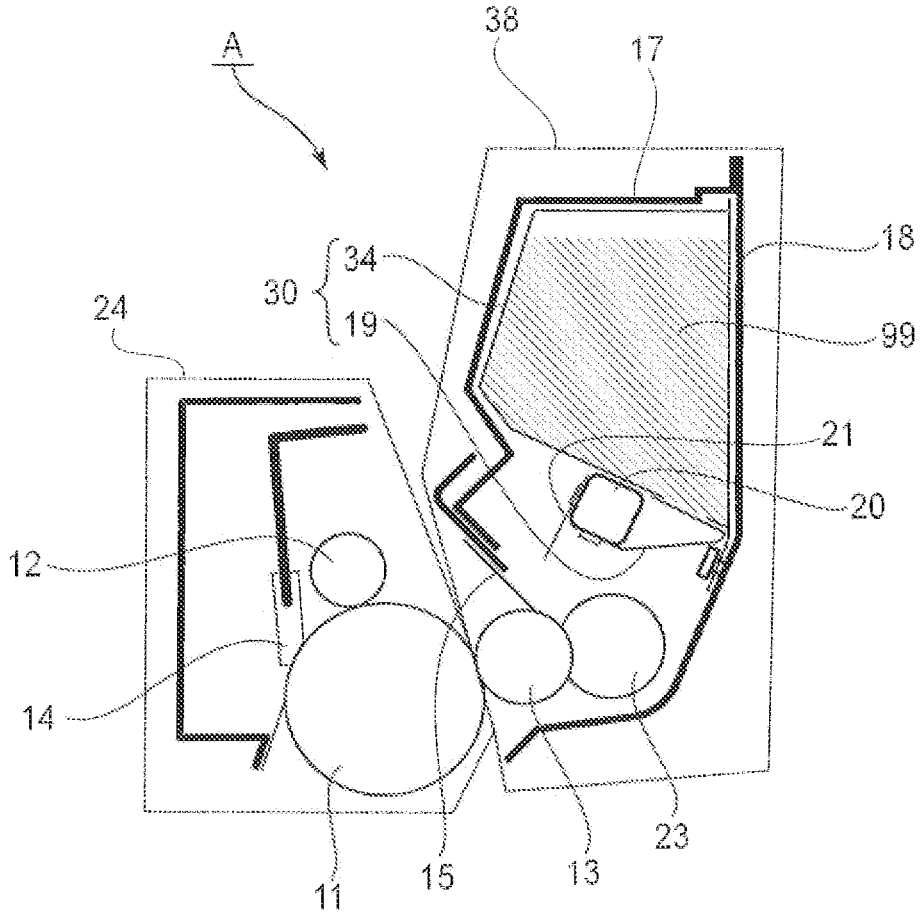
FIG. 2 is a sectional view showing a structure of a process cartridge to be mounted in the image forming apparatus as shown in FIG. 1.

FIG. 2 is a sectional view showing a structure of the process cartridge A to be mounted in the image forming apparatus main assembly B as shown in FIG. 1.

The process cartridge A in this embodiment includes, as shown in FIG. 2, the photosensitive drum 11 as the image bearing member and includes, at a periphery of the photosensitive drum 11, a charging roller 12 as the charging means and the cleaning unit 24 including an elastic cleaning blade 14. Further, the process cartridge A includes the developing unit 38 including the developing roller 13 and the developing blade 15 which constitute a developing means, the developer supplying roller 23, a developer accommodating container 30, a frame 17 and a frame 18. The process cartridge A is prepared by integrally assembling the cleaning unit 24 and the developing unit 38, and is constituted so as to be detachably mountable to the image forming apparatus main assembly B as shown in FIG. 1.

(Structure of Developing Unit)

Next, a structure of the developing unit 38 will be described.

Figure 3:
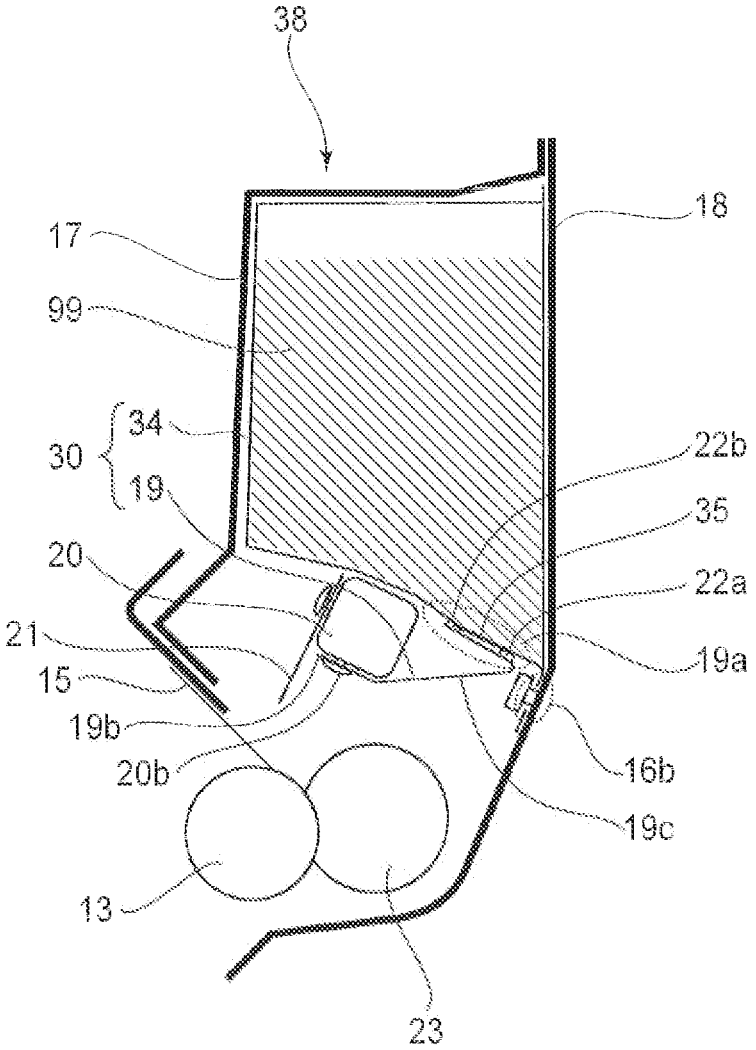
FIG. 3 is a sectional view of a developing unit before unsealing in Embodiment 1.

FIG. 3 is a sectional view of the developing unit 38 before unsealing.

As shown in FIG. 3, the developing unit 38 is constituted by the developer accommodating container 30, the developing roller 13, the developing blade 15, the developer supplying roller 23, and the frames 17 and 18 for supporting these members. The frames 17 and 18 constitute in combination a frame for accommodating the developer accommodating container 30.

Incidentally, in this embodiment, the developer accommodating container 30, the developing roller 13 and the developing blade 15 are provided in the frames 17 and 18, but the developer accommodating container 30 may also be provided in a frame which is a separate member from the frames 17 and 18. In this case, the developing unit 38 is constituted by a developer accommodating unit (not shown) in which the developer accommodating container 30 is provided, the developing roller 13, the developing blade 15 and the developer supplying roller 23. The developer accommodating unit includes at least the developer accommodating container 30 and a frame for accommodating the developer accommodating container 30.

(Structure of Developer Accommodating Container)

Figure 4:
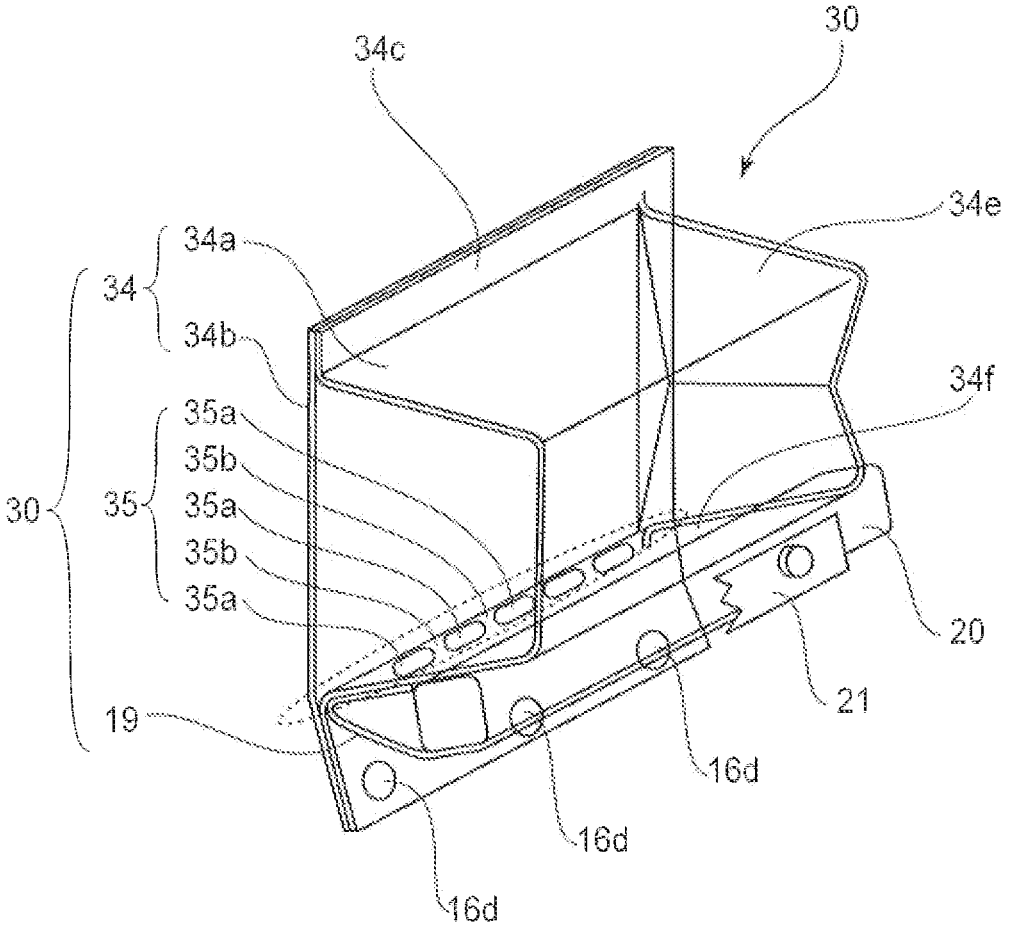
FIG. 4 is a perspective view of a developer accommodating container in Embodiment 1.

FIG. 4 is a perspective view of the developer accommodating container 30 to be incorporated into the developing unit 38.

As shown in FIG. 4, the developer accommodating container 30 is constituted by a developer accommodating member 34 and a sealing member 19 for sealing a plurality of openings 35*a* for permitting discharge of the developer and for exposing the openings 35*a* by being moved.

(Structure of Developer Accommodating Member)

As shown in FIG. 4, the developer accommodating member 34 is constituted by an accommodating portion 34*a* (first flexible member) as the flexible container having flexibility and a planar sheet member 34*b* (second flexible member) having flexibility. The accommodating portion 34*a* has a three-dimensional shape formed three-dimensionally with respect to a direction in which the accommodating portion 34*a* is departed from the sheet member 34*b*.

The accommodating portion 34*a* is formed by subjecting a sheet-like material to thermal molding, such as a vacuum molding, air-pressure molding, vacuum air-pressure molding, blow molding, injection molding, compression molding or transfer molding.

In the molding of the accommodating portion 34*a*, by using these molding methods, it is possible to subject the flexible material to high-speed processing, and in addition, it becomes possible to provide an in-line molding step in an assembling step (process).

As the material for the accommodating portion 34*a*, it is preferable that a single-layer material of ABS, PMMA, PC, PP, PE, HIPS, PET, NY, EVA, PVC or the like and a composite multi-layer material of these resins are used. Further, a thickness of the accommodating portion 34*a* may preferably be about 0.1-1 mm as a sheet-like thickness before the molding, but may only be appropriately selected depending on a cost, product specifications, a manufacturing condition and the like.

As shown in FIG. 4, the accommodating portion 34*a* is bonded to the sheet portion 34*b* at an outer peripheral member 34*c* of the accommodating portion 34*a*, and a space for accommodating the developer is formed between the accommodating portion 34*a* and the sheet member 34*b*. As a bonding method between the accommodating portion 34*a* and the sheet member 34*b*, there are thermal welding, laser welding, ultrasonic welding, solvent welding, an adhesive, an adhesive tape, and the like.

As shown in FIG. 3, the developer accommodating member 34 accommodates a developer 99 therein. Further, as shown in FIG. 4, at a part of the outer peripheral portion 34*c*, a fixing portion 16 for fixing the developer accommodating member 34 is provided. As a means for fixing the fixing portion 16*d*, it is possible to cite the thermal welding, the ultrasonic welding, adhesive bonding, clamping between the frames, thermal caulking, ultrasonic caulking, hooking using a hole and a projection, and the like, but in this embodiment, the hooking using the hole and the projection is employed.

A shape of the accommodating portion 34*a* is a shape along the inside wall of the frames 17 and 18.

By shaping the accommodating portion 34*a* by the molding method, the following effects are obtained.

That is, a gap is not formed between the developer accommodating member 34 and the frame 17, so that a developer accommodating space can be created effectively. Further, the developer accommodating member 34 can be formed in a shape which does not interfere with the frame 17 and therefore the developer accommodating member 34 can be easily incorporated into the frames. This is because there is no need to push the developer accommodating member 34 into the frames to adjust the shape during assembling.

Incidentally, the injection opening for permitting injection of the developer 99 will be specifically described later.

(Structure of Sealing Member)

As shown in FIGS. 3 and 4, the sealing member 19 covers the opening 35 of the developer accommodating member 34 before use of the cartridge A to confine the developer 99 in the developer accommodating member 34. The sealing member 19 is moved, so that the openings 35*a* (discharge openings) are exposed. The sealing member 19 is constituted by a sheet-like member including a sealing portion 19*a* for covering (sealing) the discharge portion 35 of the developer accommodating member 34, a portion-to-be-engaged 19*b* to be fixed (engaged) with the unsealing member 20, and a connecting portion 19*c* which connects the sealing portion 19*a* and the portion-to-be-engaged 19*b*. The sheet member is formed of a laminate material, described later, having a sealant layer which exhibits an easy-unsealing property, and a base material therefor is polyethylene telephthalate (PET), polyethylene, polypropylene or the like. A thickness of the sheet member may appropriately be set in a range of 0.03-0.15 mm.

The sealing portion 19*a* is a region where the sealing member 19 seals the plurality of openings 35*a* and connecting portions 35*b* of the developer accommodating member 34. By the sealing portion 19*a*, the developer 99 is prevented from being leaked from the inside of the developer accommodating member 34 until before use of the process cartridge A.

As shown in FIG. 3, on the unsealing member 20, the portion-to-be-engaged 19*b* of the sealing member 19 is fixed by a fixing portion 20*b*, and the sealing member 19 is wound up by rotation of the unsealing member 20, so that the sealing portion 19*a* is peeled off from the openings 35*a*.

Incidentally, on the unsealing member 20, an urging member 21 is fixed, and when the unsealing member 20 is rotated, the urging member 21 urges the developer accommodating member 34, so that the developer can be discharged efficiently.

(Injection of Developer)

Parts (a), (b) and (c) of FIG. 5 are perspective views showing states before and after the developer 99 is injected into the developer accommodating container 30. Part (a) of FIG. 5 is the perspective view showing the state before the injection opening 39 is opened, (b) of FIG. 5 is the perspective view showing the state in which the injection opening 39 is opened, and (c) of FIG. 5 is the perspective view showing the state after the developer is injected.

As shown in (a) of FIG. 5, the developer accommodating container 30 is not filled with the developer 99 and is provided with the injection opening 39 for permitting injection (filling) of the developer 99.

That is, the developer accommodating member 34 of the developer accommodating container 30 includes the injection opening 39 and the openings 35*a* for permitting discharge of the developer.

At first, the developer accommodating container 30 has not been yet filled with the developer.

Next, as shown in (b) of FIG. 5, the developer accommodating container 30 is filled with the developer from the injection opening 39. Further, by the flexibility of the developer accommodating member 34, the injection opening 39 is deformable correspondingly to a filling device to facilitate filling of the developer with no scattering of the developer. During the filling, a known auger type filling device is used, but another method having a similar function may also be used.

Next, as shown in (c) of FIG. 5, the injection opening 33 is bonded to form a bonding portion 39*a*, thus effecting the sealing. The bonding of the bonding portion 39*a* of the injection opening 39 is performed by the ultrasonic welding in this embodiment, but as other methods, there are the thermal welding, the laser welding, the solvent welding, the adhesive, the adhesive tape and the like.

Then, when the bonding of the bonding portion 39*a* of the injection opening 39 is completed, the filling of the developer 99 is completed.

Incidentally, a position and a size of the injection opening 39 for permitting the filling of the developer 99 are determined correspondingly to the filling device of the developer 99, the shape of the process cartridge A, and the like.

In this way, each of the openings 35*a* and the injection opening 39 of the developer accommodating container 30 is sealed and therefore the accommodated developer 99 is not leaked out to the outside, so that the developer 99 can be treated as a single unit. Further, the sealing member 19 is provided with holes as the portion-to-be-engaged 19*b* to be engaged with the unsealing member 20, thus being engageable with the unsealing member 20.

(Sealing of Injection Opening)

FIG. 6 is a perspective view of the developer accommodating member 34 for illustrating the sealing of the injection opening 39.

In the state of (a) of FIG. 5, the outer peripheral portion 34*c* of the accommodating portion 34*a* and the sheet member 34*b* are bonded by a bonding portion 34*k*. Then, the bonding portion 39*a* of the injection opening 39 is bonding-processed to the bonding portion 34*k* between the outer peripheral portion 34*c* of the accommodating portion 34*a* and the sheet member 34*b* after the developer accommodating member 34 is filled with the developer 99 and is placed in the state of (c) of FIG. 5. At this time, an overlapping portion 40 where the bonding portion 34*k* and the bonding portion 39*a* overlap with each other is formed, so that the leakage of the developer can be prevented with reliability.

(Insertion of Filling Nozzle)

The insertion of the filling nozzle for filling the developer will be described with reference to FIGS. 7 and 8. Part (a) of FIG. 7 shows the developer accommodating member 34 before the filling, and (b) of FIG. 7 shows the developer accommodating member 34 in a state in which a filling nozzle 80 is inserted through the injection opening 39 during the filling.

The developer accommodating member 34 is constituted by the sheet member 34*b* and the accommodating portion 34*a* formed three-dimensionally with respect to a direction in which the accommodating portion 34*a* departs from the sheet member 34*b*. Of sides constituting the accommodating portion 34*a*, an adjacent portion 34*h* adjacent to the injection opening 39 is a flat plane ((a) of FIG. 7), so that the adjacent portion 34*h* adjacent to the injection opening 39 is largely displaced by the insertion of the filling nozzle 80, and sides 34*e*, 34*f* and 34*g* connected with the adjacent portion 34*h* are displaced ((b) of FIG. 7).

Parts (a) and (b) of FIG. 8 are sectional views of the developer accommodating member 34 along a cross section passing through the center of the injection opening of the developer accommodating member 34 shown in (a) and (b) of FIG. 7, respectively. In order to prevent the scattering (diffusion) of the developer 99 by eliminating the gap between the developer accommodating member 34 and the filling nozzle 80 during the developer filling, an injection opening holding jig 70 consisting of injection opening holding portions 70*a* and 70*b* is needed. At this time, as shown in (b) of FIG. 8, by the insertion of the filling nozzle 80, the adjacent portion 34*h* is displaced upward in the figure so as to be largely waved and at the same time, the side 34*g* connected with the adjacent portion 34*h* causes displacement in width so as to be depressed inward, so that there is the case where a volume for permitting the injection of the developer cannot be ensured.

Further, there is also the case where it is difficult to ensure reliability of a developer filling step since a flowing path is narrowed during the injection of the developer. Further, also in a filling step in which the injection opening holding jig 70 is not used, a magnitude and instability of the displacement of the adjacent portion 34*h* becomes problematic in manufacturing in some cases such that a volume fluctuation is generated every time since predictability of a behavior of the developer accommodating member 34 is impaired.

(Folded Shape or Adjacent Side)

Next, the developer accommodating member 34 having a folded shape (creased shape) in the adjacent side 34*h* will be described with reference to FIGS. 9 and 10. Part (a) of FIG. 9 shows the developer accommodating member 34 before filling, and (b) of FIG. 9 shows the developer accommodating member 34 in a state in which the filling nozzle 80 is inserted through the injection opening 39 during the filling.

The developer accommodating member 34 is constituted by the sheet member 34*b* and the accommodating portion 34*a* formed three-dimensionally with respect to the direction in which the accommodating portion 34*a* departs from the sheet member 34*b*. Of the sides constituting the accommodating portion 34*a*, the adjacent portion 34*h* adjacent to the injection opening 39 has the folded shape configured to expand is a direction including a directional component perpendicular to the developer injection direction. Further, in this embodiment, the folded shape is capable of expanding in a direction parallel to the sheet member 34*b* ((b) of FIG. 9).

The adjacent portion 34*h* is constituted by rectilinear edges 101, 102 and 103 and flat planes 111, 112 and 113 contacted to one another at the rectilinear edges 101, 102 and 103. Incidentally, the ends of each of the edges 101, 102 and 103 are located at a same point 120. The edge 103 expands in a direction perpendicular to the sheet member 34*b*, and another end of the edge 103 is located at a boundary with the side 34*g*. Further, another end of the edge 101 is located at a boundary between the adjacent portion 34*h* and the side 34*e* and located at a point contacting the sheet member 34*b*. Further, another end of the edge 102 is located at a boundary between the adjacent portion 34*h* and the side 34*f* and located at a point contacting the sheet member 34*b*.

Further, by such a constitution of the adjacent portion 34*h*, in the case where the injection opening 39 is opened in order to insert the filling nozzle 80, forces of arrows C1, C2 and C3 of (b) of FIG. 9 are applied to portions of the injection opening 39. At this time, forces exerted on the respective flat planes 111, 112 and 1313 of the adjacent portion 34*h* by the above-described forces are changed, with respect to x, y and z directions shown in (a) and (b) of FIG. 9, from a state of (a) of FIG. 9 to a state indicated by arrows in (b) of FIG. 9. That is, an upward force is applied to each of the flat planes 111, 112 and 113 as a whole, with the result that the adjacent portion 34*h* is displaced so as to expand in directions of arrows D1 and D2 which are perpendicular to the injection direction of the developer 99 and which are parallel to the sheet member 34*b*.

That is, correspondingly to the displacement of the injection opening 39 by the insertion of the filling nozzle 80, the folded shape of the adjacent portion 34*h* constituted by the flat planes or the curved sides is expanded in the direction which is perpendicular to the developer injection direction and which is parallel to the sheet member 34*b*. For this reason, the forces exerted on the adjacent portion 34*h* can be distributed, so that the adjacent portion 34*h* is not locally displaced largely and thus it is possible to suppress the influence of the displacement of the adjacent portion 34*h* on the sides 34*e*, 34*f* and 34*g* connected with the adjacent portion 34*h* ((b) of FIG. 9).

Parts (a) and (b) of FIG. 10 are sectional views of the developer accommodating member 34 along a cross section passing through the center of the injection opening 39 shown in (a) and (b) of FIG. 9, respectively.

The developer accommodating member 34 is held by the injection opening holding jig 70, consisting of the injection opening holding portions 70*a* and 70*b*, for preventing the scattering (diffusion) of the developer by eliminating the gap between the developer accommodating member 34 and the filling nozzle 80. In this case, as shown in (b) of FIG. 10, the displacement of the adjacent portion 34*h*, such that the adjacent portion 34*h* is largely waved, generated by the displacement of the injection opening 39 caused by the insertion of the filling nozzle 80 is controlled so as to be distributed to the entire region of the adjacent portion 34*h* , whereby it is possible to ensure a volume for permitting the injection of the developer 99 and it is also possible to ensure reliability of the developer filling step.

A principal reason therefor is as follows.

When the injection opening 39 is changed from the flat plane shown in FIG. 7 to the three-dimensional shape, which is a substantially semi-cylindrical shape, by the insertion of the filling nozzle 80 as shown in FIG. 7, the adjacent portion 34*h* causes the displacement such that the adjacent portion 34*h* is largely waved.

As shown in (a) of FIG. 9, the adjacent portion 34*h* adjacent to the injection opening 39 has the folded shape, and the folded shape expands in a direction which is perpendicular to the developer injection direction and which is parallel to the sheet member 34*b*. For this reason, as shown in (b) of FIG. 9, when the injection opening 39 is three-dimensionally changed into the substantially semi-cylindrical shape by the insertion of the filling nozzle 80, the adjacent portion 34*h* is capable of opening the folded shape by the smallest displacing force in such a manner that a folded sector-shaped portion is opened, and also a direction of the displacement can be controlled in a direction in which the folded shape expands.

The accommodating portion 34*a* which is the flexible container is formed by subjecting the sheet-like material to the vacuum molding, the air-pressure molding, the vacuum air-pressure molding, the press molding, or the blow molding, but in some cases, the adjacent portion 34*h* of the accommodating portion 34*a* is set to have a reversed tapered portion within a range in which a forced removal of the sheet-like material from a mold in a removal step from the molding in the molding method.

Even when the folded shape is capable of expanding in the direction which is perpendicular to the developer injection direction and which is parallel to the sheet member 34*b*, the extension direction of the folded shape itself is not limited to the direction perpendicular to the developer injection direction, but the folded shape also includes the case where folded shape portions are parallel to each other and the case where a part of the adjacent portion 34*h* is constituted by the folded shape.

FIG. 11 is a perspective view showing the developer accommodating member 34 after the developer is filled in the case where the adjacent portion 34*h* has the folded shape. Similarly as in the case shown in FIG. 6, after the developer 99 is filled from the injection opening 39 by the filling nozzle 80, the developer accommodating member 34 is bonding-processed at the bonding portion 39*a* of the injection opening 39. At this time, an overlapping portion 40 where the bonding portion 34*k* and the bonding portion 39*a* overlap with each other is formed, so that the leakage of the developer can be prevented with reliability.

<Other Embodiments>

Other embodiments of the present invention will be described. Incidentally, portions identical or similar to those described in Embodiment 1 are represented by the same reference numerals or symbols and will be omitted from redundant description.

FIG. 12 is a perspective view of a developer accommodating container 30 showing the case where also an outside portion side 34*g* adjacent to an adjacent portion 34*h* adjacent to an injection opening 39 has a folded shape.

As shown in FIG. 12, in addition to the constitution in Embodiment 1 shown in FIG. 11, also the side 34*g* adjacent to the adjacent portion 34*h* has the folded shape. That is, the folded shape is provided by rectilinear edges 131, 132, 133, 134 and 135 and flat planes 141, 142, 143 and 144 contacted to one another at these edges. By this folded shape, compared with the case of Embodiment 1 shown in FIG. 11, it is possible to displace the developer accommodating container 30 so as to largely open with respect to a direction which is perpendicular to the injection direction of the developer 99 and which is parallel to the sheet member 34*b*.

FIG. 13 is a perspective view showing a structure of a developer accommodating container 30 in the case where an adjacent portion 34*h* adjacent to the injection opening 39 includes a curved side.

As shown in FIG. 13, the adjacent portion 34*h* has a folded shape provided by a curved edge 150 and flat planes 161 and 162 contacted to each other at the edge 150. Incidentally, one end of the edge 150 is located at a boundary between the adjacent portion 34*h* and a side 34*e* and at a point contacting the sheet member 34*b*. Another end of the edge 150 is located at a boundary between the adjacent portion 34*h* and a side 34*f* and at a point contacting the sheet portion 34*b*.

By thus constituting the folded shape, similarly as in Embodiment 1 shown in FIG. 11, in the case where the injection opening 39 is opened, it is possible to displace the adjacent portion 34*h* so that the developer accommodating container 30 opens with respect to a direction which is perpendicular to the injection direction of the developer 99 and which is parallel to the sheet member 34*b*.

Parts (a) to (d) of FIG. 14 are perspective views of developer accommodating containers showing variations of other folded shapes. Incidentally, in each of (c) and (d) of FIG. 14, a perspective view showing a state in which a filling nozzle 80 is inserted from an injection opening 39 into the developer accommodating container 30 having the folded shape is also shown.

The folded shape, as one of the variations, shown in (a) of FIG. 14 includes edges 171, 172, 173 and 174 and is provided with flat planes so as to connect these sides. Further, the edges 171 and 174 are perpendicular to the injection direction of the developer 99 and are substantially perpendicular to also the flat plane of the sheet member 34*b*.

The folded shape, as one of the variations, shown in (b) of FIG. 14 includes edges 181, 182, 183 and 184 and is provided with flat planes so as to connect these sides. Further, these edges 181, 182, 183 and 184 are perpendicular to the injection direction of the developer 99 and are substantially perpendicular to also the flat plane of the sheet member 34*b*.

The folded shape, as one of the variations, shown in (c) of FIG. 14 includes edges 191, 192, 193, 194 and 195 and is provided with flat planes so as to connect these sides. Further, these edges 191, 192, 193, 194 and 195 are perpendicular to the injection direction of the developer 99 and are substantially perpendicular to also the flat plane of the sheet member 34*b*. Further, as a variation of (c) of FIG. 14, it is also possible to employ a constitution in which portions of the folded shape are not parallel to each other but constitute a sector shape or the like having a certain angle.

The folded shape, as one of the variations, shown in (d) of FIG. 14 includes edges 201, 202, 203, 204, 205, 206 and 207 and is provided with flat planes so as to connect these sides. Further, these edges 201 to 207 are perpendicular to the injection direction of the developer 99 and are substantially parallel to the flat plane of the sheet member 34*b*.

In either case of (a) to (d) of FIG. 14, similarly as in Embodiment 1, the displacement of the adjacent portion 34*h*, such that the adjacent portion 34*h* is largely waved, generated by the insertion of the filling nozzle 80 is controlled so as to be distributed to the entire region of the adjacent portion 34*h*, whereby it is possible to ensure a volume for permitting the injection of the developer 99 and it is also possible to ensure reliability of the developer filling step.

According to the present invention, the three-dimensional-shaped adjacent portion, of the first flexible member, adjacent to the injection opening has the folded shape (creased shape), and when the injection opening is opened, by the folded shape, the adjacent portion expands in the direction including a directional component perpendicular to the developer injection direction. For this reason, in the case where the filling nozzle is inserted through the injection opening in order to inject the developer, the deformation of the developer accommodating container can be controlled, so that a volume for permitting the injection of the developer is ensured and thus it is possible to prevent a lowering in reliability of the filling step caused by a narrowed injection path.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 199455/2012 filed Sep. 11, 2012, which is hereby incorporated by reference.

What is claimed is:

1. A developer accommodating container for accommodating developer for image formation, said developer accommodating container comprising:

a first flexible member having a folded shape; and a second flexible member bonded to said first flexible member, wherein an injection opening is formed between bonded portions of said first flexible member and said second flexible member for permitting a developer injecting nozzle to be inserted between said first flexible member and said second flexible member in a vertical direction, and wherein said folded shape does not cross a plane that extends in the vertical direction through said bonded portions of said first flexible member and said second flexible member and a plane that extends in a horizontal direction through said bonded portions of said first flexible member and said second flexible member.

2. A developer accommodating container according to claim 1, wherein said second flexible member has a planar shape, and wherein, when said injection opening is opened, by the folded shape, an adjacent portion of said first flexible member expands in a direction including a directional component which is perpendicular to the injection direction of the developer at said injection opening and which is parallel to said second flexible member.

3. A developer accommodating container according to claim 2, wherein the folded shape includes a plurality of rectilinear edges each expanding in a direction perpendicular to said second flexible member and includes a plurality of flat planes connecting the rectilinear edges.

4. A developer accommodating container according to claim 1, wherein the folded shape includes an outside portion adjacent to a portion of said first flexible member having the folded shape.

5. A developer accommodating container according to claim 1, wherein the folded shape includes a rectilinear edge and a plurality of flat planes each contacting the rectilinear edge.

6. A developer accommodating container according to claim 1, wherein the folded shape includes a curved edge and a curved side contacting the curved edge.

7. A developer accommodating container according to claim 1, wherein after the developer is injected through said injection opening, said injection opening is sealed by bonding.

8. A developer accommodating container according to claim 7, further comprising a discharging opening for permitting discharge of the developer from accommodated in said developer accommodating container and for being used for the image formation.

9. A process cartridge detachably mountable to a main assembly of an image forming apparatus, said process cartridge comprising:

a developer accommodating container according to claim 8; and a developer carrying member for carrying the developer discharged from said injection opening of said developer accommodating container.

10. An image forming apparatus comprising:

a process cartridge according to claim 9; and transfer means for transferring an image, formed by development by said process cartridge, on an image forming material.

11. A developer accommodating container according to claim 1, wherein the folded shape is formed by using thermal molding.

12. A developer accommodating container according to claim 11, wherein the thermal molding is one of vacuum molding, air pressure molding, blow molding, injection molding, compression molding, and transfer molding.

13. A developer accommodating container according to claim 1, wherein said first flexible member and said second flexible member are bonded by using one of thermal welding, laser welding, ultrasonic welding, solvent welding, an adhesive, and an adhesive tape.

14. A developer accommodating container according to claim 1, wherein the folded shape includes a rectilinear edge and a plurality of flat planes each contacting the rectilinear edge.

15. A developer accommodating container according to claim 1, further comprising:

a sealing member for sealing a discharging opening of said second flexible member through which the developer is discharged.

16. A developer accommodating container according to claim 15, further comprising:

an unsealing member for moving said sealing member to open said discharging opening.

17. A developer accommodating container according to claim 16, wherein said injection opening is located at one end side of said unsealing member with respect to an axial direction of said unsealing member.

18. A developer accommodating container according to claim 16, wherein said second flexible member has a plurality of discharging openings and said plurality of discharging openings is arranged along an axial direction of said unsealing member.

19. A developer accommodating container according to claim 15, wherein, when said sealing member is unsealed, said second flexible member is deformable to change a shape of said discharging opening.

20. A developer accommodating container according to claim 1, wherein said second flexible member has a discharging opening through which the developer is discharged from the space.

21. A developer accommodating container according to claim 1, wherein said folded shape includes three edges.

* * * * *